US009156044B2

(12) United States Patent
Sventitsky et al.

(10) Patent No.: US 9,156,044 B2
(45) Date of Patent: Oct. 13, 2015

(54) AEROSOL DEVICE

(75) Inventors: Yevgeny Nikolayevich Sventitsky, St. Petersburg (RU); Valery Mikhailovich Glushchenko, Leningrad Province (RU); Yury Nikolayevich Tolparov, St. Petersburg (RU)

(73) Assignee: Battelle Memorial Institute, Richland, WA (US)

( * ) Notice: Subject to any disclaimer, the term of this patent is extended or adjusted under 35 U.S.C. 154(b) by 387 days.

(21) Appl. No.: 12/999,893

(22) PCT Filed: Dec. 19, 2008

(86) PCT No.: PCT/RU2008/000782

§ 371 (c)(1),
(2), (4) Date: Mar. 4, 2011

(87) PCT Pub. No.: WO2009/157803

PCT Pub. Date: Dec. 30, 2009

(65) Prior Publication Data

US 2011/0284596 A1 Nov. 24, 2011

(30) Foreign Application Priority Data

Jun. 25, 2008 (RU) ..... 2008125421
Jun. 25, 2008 (RU) ..... 2008125423

(51) Int. Cl.
*B05B 3/04* (2006.01)
*B05B 3/06* (2006.01)
(Continued)

(52) U.S. Cl.
CPC ..... *B05B 7/10* (2013.01); *B05B 7/0475* (2013.01); *B05B 15/064* (2013.01); *B05B 15/068* (2013.01)

(58) Field of Classification Search
CPC ..... B05B 7/10; B05B 7/0475; B05B 15/064; B05B 15/068
USPC ..... 239/263, 433, 463, 468, 469, 470, 251, 239/253, 261
See application file for complete search history.

(56) References Cited

U.S. PATENT DOCUMENTS 1,390,048 A * 9/1921 Lange ..... 239/470
2,275,189 A * 3/1942 Wieghart ..... 134/186
(Continued)

FOREIGN PATENT DOCUMENTS

EP 0924460 A1 12/1997
WO 2008068411 A2 6/2008
WO 2008122030 A2 10/2008

OTHER PUBLICATIONS

International Search Report/Written Opinion for International Application No. PCT/US2009/048765, filed Jun. 26, 2009, Date of Mailing Dec. 30, 2009.
(Continued)

*Primary Examiner* — Len Tran
*Assistant Examiner* — Steven M Cernoch
(74) *Attorney, Agent, or Firm* — Derek H. Maughan

(57) ABSTRACT

The invention relates to devices for air humidification, aerosol vaccination and disinfection, inhalation chemotherapy and for protection of plants against pests and diseases. The inventive aerosol nozzle-based device comprises a cylindrical container in which ejector atomizers are arranged above a liquid surface in such a way that they can rotate in a horizontal plane. Each atomizer comprises a chamber which is provided with a nozzle and into which branch pipes for supplying a liquid material to be atomized and air are introduced. The air supply branch pipes are tangentially arranged in the chamber. The atomizers are mounted in such a way that a jet coming out therefrom is chordwisely oriented with respect to the walls of the cylindrical container. The projection of the central axis of the aerosol spray on the cylinder walls does not cross the top edge of the walls during at least one turn. The dimensions of the branch pipe openings and of the nozzle are related by the equation $Do=(0.5\div0.7)D^2c/Dk$, wherein Do is the diameter of the liquid supply branch pipe, Dc is the diameter of the outlet nozzle and Dk is the diameter of the air inlet channel. Said invention makes it possible to produce a stable fine aerosol.

4 Claims, 4 Drawing Sheets

(51) Int. Cl.

| | |
|---|---|
| ***B05B 7/04*** | (2006.01) |
| ***B05B 1/34*** | (2006.01) |
| ***B05B 7/10*** | (2006.01) |
| *B05B 15/06* | (2006.01) |

(56) References Cited

U.S. PATENT DOCUMENTS

| | | | | | |
|---|---|---|---|---|---|
| 3,428,131 | A | * | 2/1969 | Winslow | 169/15 |
| 3,587,975 | A | * | 6/1971 | Moffett | 239/428.5 |
| 3,814,322 | A | * | 6/1974 | Waldrum | 239/251 |
| 3,897,000 | A | * | 7/1975 | Mandt | 239/722 |
| 4,043,766 | A | * | 8/1977 | Gernhardt et al. | 48/73 |
| 4,109,862 | A | * | 8/1978 | Hughes | 239/405 |
| 4,512,935 | A | | 4/1985 | Hilmersson et al. | |
| 4,680,163 | A | | 7/1987 | Blidschun et al. | |
| 5,253,809 | A | * | 10/1993 | Poppitz et al. | 239/257 |
| 5,810,262 | A | * | 9/1998 | Ton | 239/428.5 |
| 6,012,645 | A | * | 1/2000 | Poppitz | 239/104 |
| 2006/0175430 | A1 | * | 8/2006 | Bardehle | 239/251 |
| 2007/0186368 | A1 | | 8/2007 | Field et al. | |
| 2008/0058549 | A1 | | 3/2008 | Jessop et al. | |
| 2011/0135757 | A1 | * | 6/2011 | Sventitskyi et al. | 424/680 |

OTHER PUBLICATIONS

Atchinson, M., Sanitation without the Wetting Issues, Cleanroom Technology, Sep. 2007, pp. 22-23.

Melnikova, V. M., et al., Prevention and Therapy of Nosocomial Infections Using Electrochemically Activated Solutions, Vitold Bakhir Electrochemical Systems and Technologies, , Bulletin of Vinnitsa State Medical University, 2000, 2:327-328.

Our Service, Validated Hygiene Solutions, Ltd.

Validated Hygiene Solutions, Ltd. Client References.

* cited by examiner

AEROSOL DEVICE

TECHNICAL FIELD

The invention relates to the technical field, specifically to devices for atomizing liquids to obtain finely dispersed aerosols. The device can be used in medicine, veterinary practice, the food industry, biotechnology and also in transport and related areas of science, technology and production.

PRIOR ART

Currently various devices that operate both based on compressed air and other principles for atomizing liquid drops are used to obtain finely dispersed aerosols.

Atomizers are known that comprise a pipe connected to the source for liquid supply with atomizers situated along its length. These atomizers make it possible to treat large areas (the length of a rod of regular sprinkers is ~1-6 m). [Jesuya. Atomizing raw and residual oil products. Energy Machines, 1979, vol. 101, no. 2, pp. 44-51; Kim, K. V., Marshall, W. R., Drop size distributions from pneumatic atomizers. A. I. Ch. Journal, 1971, vol. 17, no 3, pp. 575-584.] However, owing to the low atomization quality (with drop diameter of hydraulic atomizers being from 200-500 μm) and the possibility that atomizer nozzles will become stopped up when atomizing mixture compositions, their application is rather limited.

Better results are achieved when an internal-mixing atomizer is used, comprising pipes with branch pipes for feeding liquids and compressed air, distributed along its wall by outlet channels and a plugged butt end (SU 1248671, 1984).

The defect in this atomizer is low efficiency of the dispersion process, which is linked with increasing frictional losses when the liquid and air are moved in a curvilinear pipe, and also that the air-liquid mixture flow is unstable.

Pneumatic atomizers known to obtain an aerosol are known which comprise a straight-jet nozzle connected to a source of gas feed and a coaxially placed branch pipe for gas feeding [Kim, K. V. Marshall, W. R., Drop size distributions from pneumatic atomizers, A. I. Ch. Journal, 1971, volume 17, no. 3, pp. 575-584]. These atomizers are characterized by high productivity, but they produce a long, narrow flare, which makes it more difficult to evenly distribute the aerosol in the cavity undergoing processing. When liquids are atomized, the possibility that the nozzle will be clogged by random admixtures due to its small passageway cross section cannot be excluded.

A mechanism is known for aerosol creation that consists of an assembly for feeding the atomizing agent (compressed air), an ejector-based atomizing assembly and a hermetically-sealed vessel with an atomizing solution in which a tube is placed that connects it with the atomizing assembly (RU 2060840, 1992). The deficiency of the device is its relatively low productivity of finely dispersed aerosols.

A mechanism is known for disinfecting water-piping devices (RU 2258116), in which a sprayer is proposed as the aerosol generator. If the sprayer is used, only a coarsely dispersed aerosol is obtained with particle sizes of 70-80 μm.

The deficiency of this mechanism is that under these conditions it is impossible to obtain a stable finely-dispersed aerosol which would provide for reliable treatment of the surfaces of the space over a sufficiently lengthy time.

Centrifugal aerosol generators are known (RU 2148414, RU 2258116) in which dispersion occurs with feed of the liquid to a disk of a generator rotating at a speed of not less than 20,000 r.p.m. Atomization with the aid of a disk atomizer (RU 2180273) is conducted as a rule without the aerosol mixing with air. The advantage of these devices is the possibility to minimize the negative effect of air when an active aerosol is formed. However, for formation of drops with sizes of less than 10 μm, the thickness of the film spreading about the rotating surface must be several μm. The device has found application in dispersing aqueous solutions to form an aerosol with a particle size of about 100 μm [V. F. Dumsky, N. V. Nikitin, M. S. Sokolov, Pesticidal aerosols. Moscow: Nauka Press, 1982-287 pp.]

The deficiency of such devices is the relatively low productivity, amounting to several ml per minute, mechanical unreliability and also its being inapplicable for atomization of highly viscous liquids, and also heterogeneous mixtures.

To obtain aerosols, atomizers are also used in which the liquids are dispersed with the aid of ultrasound [V. F. Dumsky, N. V. Nikitin, M. S. Sokolov, Pesticidal aerosols. Moscow: Nauka Press, 1982-287 pp.] The advantage of such devices is sufficiently productive generation of a highly disperse aerosol with particle sizes of several μm. The deficiency of this technology is that it cannot be used for dispersion of nonaqueous liquids, high-viscosity solutions, and also heterogeneous mixtures [K. Nikander: Drug delivery systems, J. Aerosol. Med., 1994; 7 (Suppl. 1): pp. 519-524.]

SPECIFICATION OF THE INVENTION

The technical task solved within the framework of the applied-for technical solution, was create a universal device for aerosol creation that operates using virtually all liquids including solutions, suspensions and emulsions, and which permits creation of concentrated highly dispersed aerosols that have in their composition aerosol particles with a dimension of 1 μm or less, preserving the properties of the atomized solution over a relatively lengthy period of time.

The problem presented is solved by creating a device for obtaining finely dispersed aerosol in which the dispersal occurs in two stages, in the first of which the drops of the atomized substance are mixed with turbulent air flow and subject to preliminary dehydration, and in the second stage it is subjected to additional water removal and separation, as a result of which the aerosol is enriched by a fraction with a particle size in the area of 1 μm and less.

The technical result is achieved by using no less than one ejector as an atomizer, containing an internal mixing chamber into which the atomizing substance is fed, and tangentially relative to the walls of the internal chamber, air, with the size ratio of cross sections of branch pipes of delivered air of the liquid and the outlet aperture of the ejector nozzle being chosen so that it amounts to $Do=(0.5\div0.7)D^2 c/DK$, where Do is the diameter of the branch pipe for liquid feed, Dc is the diameter of the outlet nozzle, Dk is the diameter of the entry channel of delivered air, while the ejectors themselves are situated in a cylindrical container so that the flow exiting it is directed chordwisely relative to the walls of the cylindrical container, with the projection of the central axis of the aerosol flame onto the cylinder walls not intersecting the upper edge of the walls at least during one turn, which ensures that the aerosol particles do not rotate in the container less than one turn.

As a result of using a chamber with these parameters in the first stage, success is had in ensuring tangential vortex motion in the atomizing chamber, resulting in uniform distribution of the aerosol particles fragmented by vortex flows, inflow of drier exterior air into the central part of the chamber and partial water removal and reduction in aerosol particle sizes during contact of the liquid drops and dry air.

When the flow leaves the ejector nozzle, the air expands and cools, resulting in further water removal from the aerosol drops. Such an atomizer structure permits aerosols to be obtained already at the nozzle exit with an average particle diameter of 8-10 μm. During their time in the vessel, the drops are subjected to further water removal and reductions in their size due to mass transfer with water entering from the ambient environment through the central part of the vessel due to formation of a local pressure drop forming. At the same time, due to the chordwise directivity of the sprayer flare relative to the wall of the generator vessel, the largest aerosol drops, as they move in circles within the vessel, reach the vessel wall and flow off on it, ensuring an additional increase in the finely-disperse fraction content upon exiting the generator.

The inclination angle of atomizers, and correspondingly the dwell time of aerosol drops in the vessel is as a rule chosen so as to ensure that aerosol particles rotate in the vessel for not less than one turn. With this, the tangential flow in the vessel ensures lowered pressure in the center of the vessel, additional inflow of external air, dilution of the aerosol, and additional reduction in the particle size to 3-5 μm.

The inclination angle for the ejectors is selected experimentally, based on the problems to be solved using the device. Increasing the aerosol dwell time in the vessel lowers the productivity of the device, at the same time lowering the size of aerosol drops; conversely, reducing aerosol dwell time in the vessel increases the productivity of the device, while simultaneously making the aerosol more widely dispersed. Usually the mechanism comprises 1 or more ejector atomizers situated above the surface of the liquid with an option to turn them relative to the horizontal plane.

Within the vessel, for better separation of the widely dispersed aerosol particles a reflector may be situated that is in the form of a horizontal plate. As a rule the vessel is designed to be open, but if necessary, for example for aerosol transport, it may additionally be equipped with a diffuser with branch pipe.

The atomizing device permits aerosols to be formed from solutions with varied viscosity containing solvents, emulsions and suspensions of organic and inorganic materials including solutions containing foaming or chemically unstable substances, for example, virtually precluding application of atomizers of different designs to obtain finely dispersed aerosol.

BRIEF DESCRIPTION OF DRAWINGS

The overall diagram of the device for aerosol formation is presented in FIG. 1; the main diagram of the aerosol generator in FIG. 2; a diagram of the ejector atomizer in FIG. 3; and a diagram of the aerosol generator in a version with a cover in FIG. 4.

The following designations are used in the diagrams:

1—aerosol generator (AG)
2—vessel with atomizing material (VAM)
3—flow meter (FM)
4—compressor with motor (CM)
5—pressure reducer (PR)
6—manometer (M)
7—filter (F)
8—chamber with material being processed (CMBP)
9—vortex ejector atomizer (VEA)
10—body of the vessel
11—outlet
12—runout
13—support
14—coupling for admitting the atomizing agent
15—connecting pipes
16—coupling for diversion of atomizing agent
17—attaching ring
18—liner
19—nut
20—insert
21—stopper
22—reflector
23—cylindrical VEA chamber
24—tangential channels for feeding of compressed gas
25—VEA outlet nozzle
26—branch pipe for liquid feed (BPLF)
27—cover
28—outlet branch pipe
29—wing nut.
30—gasket

Optimal Implementation Version

Figure 1:
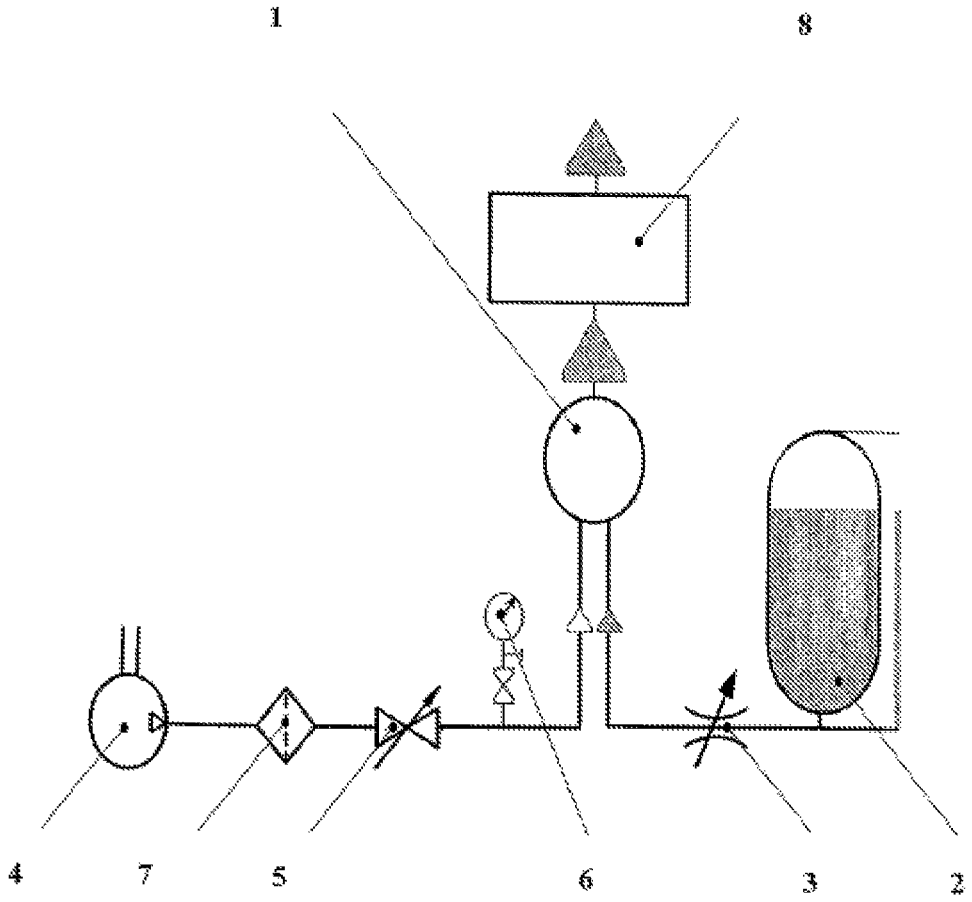

The device for aerosol formation, which has the conditional abbreviated name of DAF (FIG. 1) comprises an aerosol generator 1, feed lines for the atomizing agent connected with it, comprising a vessel with atomizing material 2, equipped with a flow meter 3 and a line for supplying the atomizing agent, into which enter sequentially a compressor with motor 4, a pressure reducer 6 with a manometer 7 and a filter 5. Additionally able to be comprised in the device is a chamber for arrangement of the material being processed 8, and a connected pipe for transport of the aerosol with the generator 1.

Figure 2:
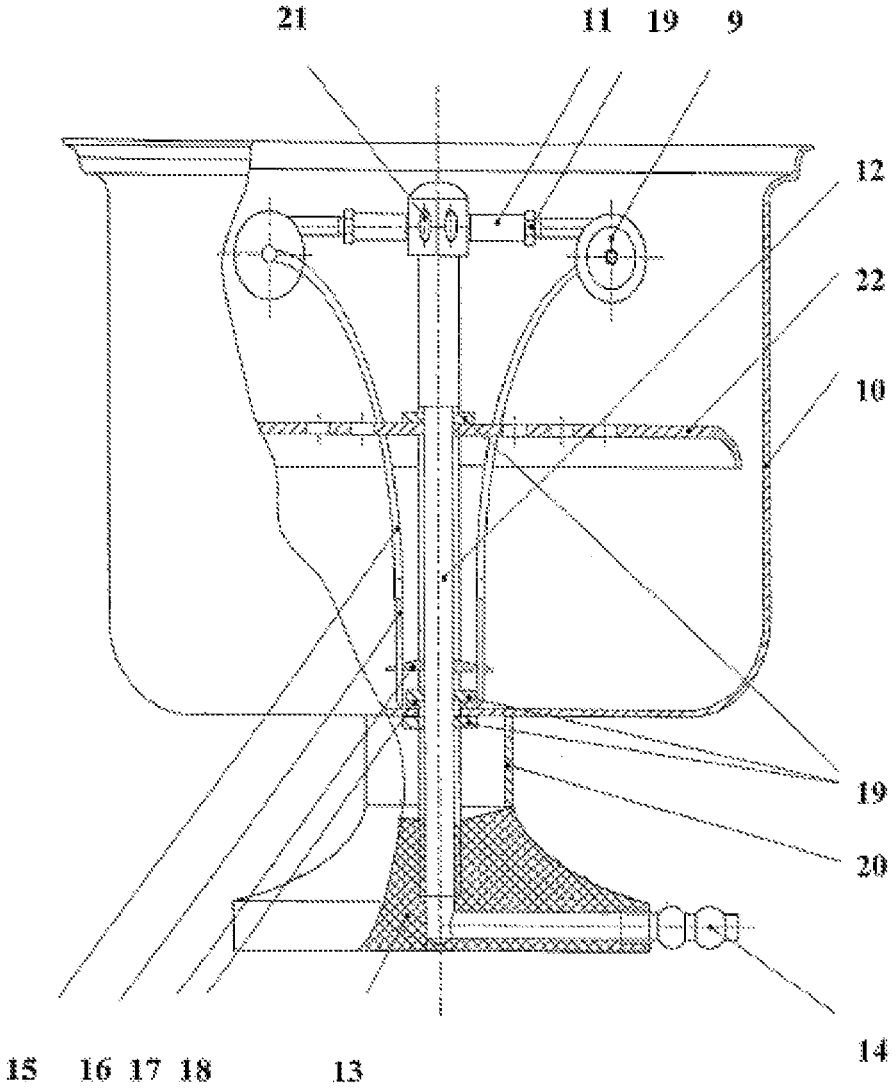

The aerosol generator 1 (FIG. 2) comprises vortex ejection atomizers 9 situated within the cylindrical body of the vessel 10 so that the aerosol flow (flare) is directed chordwisely to its walls. There are from 1 to 6 atomizers 9 depending on the particulars of the problem to be solved. If necessary, some of the atomizers 9 are dismantled, and in their place stoppers 21 are arranged.

To ensure there is a possibility of operating in various modes, the ejectors are set up so that it is possible to turn them relative to the horizontal plane, resulting in a change in direction of the atomizing liquid flare. To disperse a liquid with a minimum particle size, the atomizers are placed as a rule so that the projection of the central axis of the aerosol flare toward the cylinder wall does not intersect the upper edge of the wall at least in the course of one turn, which ensures the aerosol particles will perform a circling motion in the vessel for not less than one turn.

The atomizers 9 are attached to outlets 11 of the runout 12 with an option for a fixed turn within body 10. The outlets 11 are attached to the threaded pin of runout 12, the lower end of which is screwed into a base 13 and is joined with the coupling for admitting the atomizing agent 14.

The atomizers 9 are connected by polyvinyl chloride tubes 15 to couplings for diversion of the atomizing product 16. These tubes are fixed using a ring 17 and a liner 18 and hermetic sealing of the vessel of body 10 is ensured by the nuts 19. Using insert 20, it is possible to alter the positions of the atomizers 9 relative to the height of body 10.

At the threaded pin of runout 12, a horizontal reflecting plate 22 is horizontally attached using the nuts 19; the height of the arrangement can be adjusted by movement along runout 12.

If necessary, a diffuser 28 is mounted in the body of vessel 10, which may be detachably connected by the pipe with a ventilation system for disinfecting the filters of this system or with the chamber 8, where the material treated with aerosol is situated.

Figure 3:
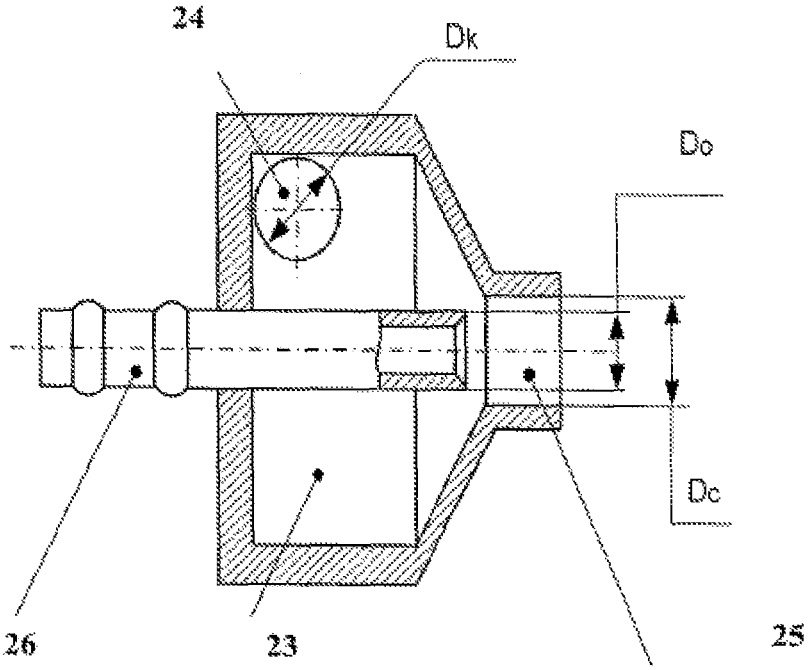

The vortex ejection atomizers 9 (FIG. 3) comprise a cylindrical chamber 23 with tangential channels 24 for feeding compressed gas and with an axial outlet nozzle 25. Placed coaxially with nozzle 25 in chamber 23 is a branch pipe 26 for feeding liquid. The ratio of dimensions of the elements is determined by the formula $Do=(0.5\div0.7)\,D^2\,c/DK$, where Do is the diameter of branch pipe 26, Dc is the diameter of nozzle 25, and Dk is the diameter of entry channel 24.

Figure 4:
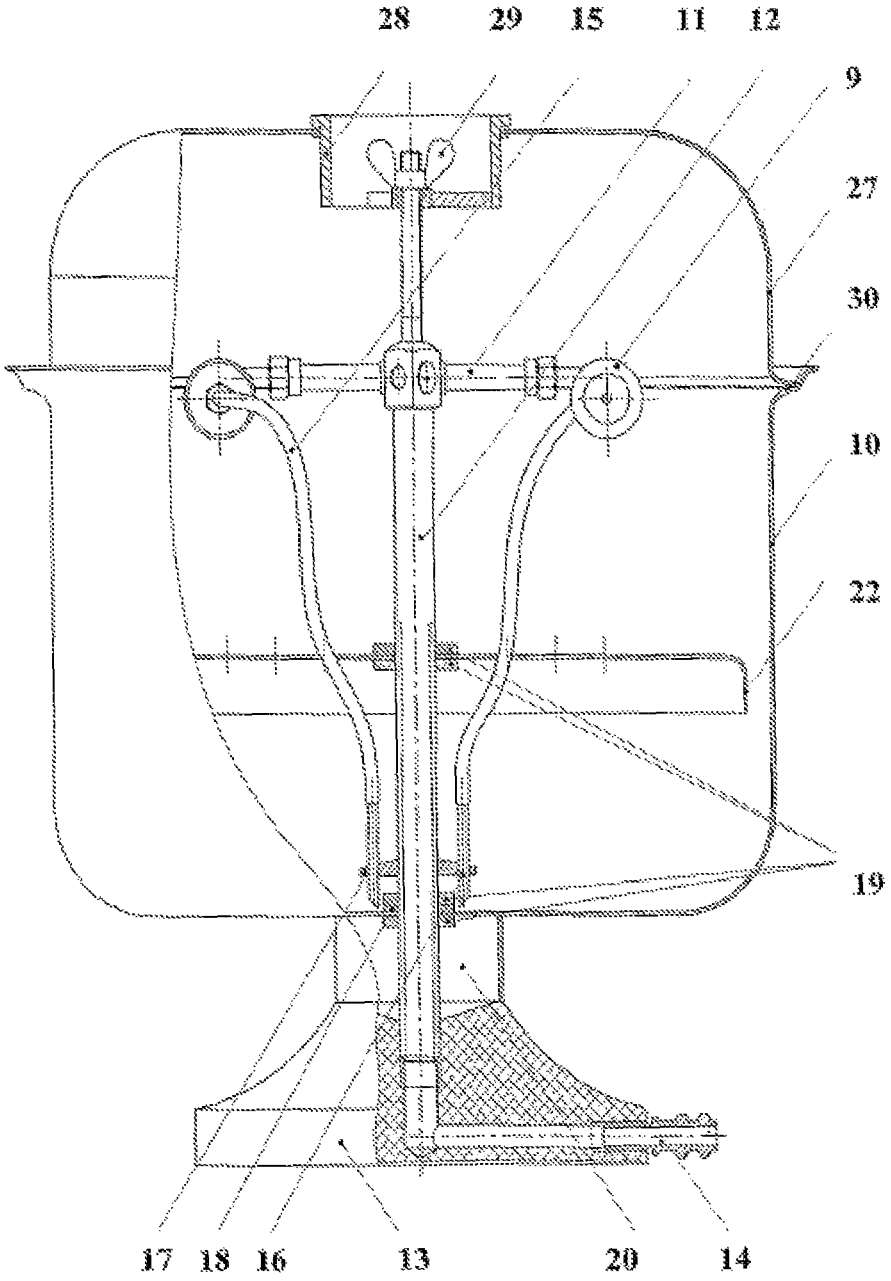

If there is a need to further transport the aerosol, a cover 27 comprising branch pipes 28 and a gasket 30 (FIG. 4) is attached onto body 10 at the pin of 12 and is secured by a wing nut 29.

The device for aerosol formation operates in the following way. Depending on the problem to be solved, atomizers 9 in the requisite number are placed on the outlets 11 of runout 12. When conducting operations with atomization of preparations in the compartment or in chamber 8, a coupling 14 is connected to compressor 4 using a flexible hose; from vessel 2, disinfectant is fed into body 10, after which compressor 4 is connected to the electrical grid and turned on to operate. With the aid of reducer 5, pressure is created in the intake hose to the generator, which is regulated by manometer 6. The atomizing air passes through filter 7 into generator 1 via coupling 14 and on via the channel inside of support 13, through runout 12, and reaches the ejector atomizers 9.

Tangential feed-in of air through channel 24 in vortex chamber 23 of the atomizers 9 forms a twisted flow, after which the air passes out through nozzle 25. With this, the maximum angular velocities of the gas are attained close to the surface of branch pipe 26, while along the axis of chamber 23 the gas flow is rarefied to 0.03 MPa and flows backward. When the air reaches chamber 23 from the compressor, its pressure drops, which reduces the relative humidity to 15-20%.

Through the pipes 15 and branch pipe 26, from the lower part of body 10, liquid passes into chamber 23 with a linear velocity of 0.15 to 0.6 m/s, which is captured by reverse flows of gas, is brought into the zone of maximum gas angular velocity, and is broken up by centrifugal forces. With this, the dispersed liquid is subjected to partial dehydration as it is distributed in the dry air.

The aerosol formed in the air flow passes into vessel 10 via nozzle 25. With this the air pressure is reduced, resulting in expansion of it and a lowering of relative humidity, which in turn leads to additional dehydration and reduction in liquid drop size.

The chordwise placement of the atomizers ensures that the two-phase flow swirls within body 10, with the large drops precipitating onto the walls of the vessel and the reflector 22, after which they flow down to the bottom of the vessel, while the small ones are removed by tangential air flow which makes at least one revolution within the body. The tangential flow creates rarefaction along the axis of vessel 10, evoking a flow into the vessel of dry air from the compartment, and further dehydration and reduction in drop size, which results in the aerosol being enriched by a fraction with particle sizes of about 1 μm. The aerosol thus obtained passes into the compartment or through the branch pipes 28 and the pipe and reaches chamber 8, where it acts on the treated material. Since aerosol drops pass into the compartment that are surrounded by a "pillow" of air, moving at the same speed, there is no "head-on collision" with the air of the compartment, which precludes possible deactivation if unstable liquids are used. As a result, an aerosol is successfully obtained that maintains its activity at the level of the output liquid solution, and possesses a greater penetrating ability due to the presence in its composition of a significant fraction with particle sizes around, and less than, 1 μm.

The authors compared aerosols obtained using air and without it, employing ultrasonic dispersion. It was shown that atomization in the presence of air permits an aerosol to be obtained that is considerably more stable and finely dispersed over a wide range of conditions.

Commercial Application

EXAMPLE 1

Study of the Effect of AG Operating Mode on its Productivity and on Aerosol Particle Size The tests were conducted while using the AG with four vortex sprayers operating at a supplied air pressure of 0.25 MPa and flowing at 300 liters/minute. The results of the tests to form water aerosol, in which a determination was made of the amount of liquid atomized over unit of time (M), mass median drop diameter ($d_{mmd}$) and maximum drop size comprising 95% of the weight of generated aerosol ($d_{95\%}$), depending on the modes used, are presented in table 1. Three operational modes of the device were used:

A—a mode with the cover 12 closed and with the atomizers 9 placed on outlets 11 with a directing of flares of liquid atomization within the body 10, with the result being a twofold separation of large drops, and the most finely dispersed aerosol appearing at the outlet of generator 1;

B—a mode with the cover 27 off and with placement of atomizers 9 with a directing of flares of liquid atomization within the body 10. With this, the runout 12 is attached to support 13 with no insert 20, while the atomizers 9 are placed below the upper edge of body 10. During aerosol formation, a one-time separation of drops is provided on the walls of body 10, which ensures that the aerosol will be sufficiently highly dispersed, and the device will be more productive as compared to mode A.

C—a mode with cover 27 removed and atomizers 9 situated with the flares of the atomizing liquid directed to outside body 10.

TABLE 1

Dependence of productivity of an AG and the degree of dispersion of the aerosol being generated on generator operational modes: an average as per results of three independent measurements.

| operating mode | M, ml/minute | $d_{mmd}$, μm | $d_{95\%}$, μm |
|---|---|---|---|
| A | 5.0 ± 0.1 | 3.1 ± 0.2 | 6.2 ± 0.3 |
| B | 63 ± 1 | 3.6 ± 0.3 | 8.8 ± 0.5 |
| C | 360 ± 2 | 8.0 ± 0.5 | 21.0 ± 0.8 |

From the data presented it follows that when changing modes from A to B and C, the productivity of the AG and the size of aerosol drops increase sequentially.

EXAMPLE 2

Dependence of Device Productivity and Aerosol Particle Size on the Position and Orientation of the Vortex Sprayer in the Body of the Vessel Aerosol formation trials were conducted under the conditions of example 1 with the AG operating in mode B. A 3% aqueous solution of sodium chloride was dispersed.

The vortex sprayers were placed at a height of 40 mm from the bottom of the body and 20 mm from the surface of the liquid being dispersed. The distances (L) from the outer edge of the sprayers to the inner surface of the body were varied, as were the directional angles ($\acute{\alpha}$) of the sprayer nozzles relative to the horizontal plane. The results of the trials are presented in table 2.

TABLE 2

Dependence of productivity of the generator and degree of disperson of aerosol generated on the position and orientation of the sprayers.

| Position of sprayers | | Results of trials | |
|---|---|---|---|
| L, mm | $\acute{\alpha}$, degrees | M, ml/minute | $d_{mmd}$, μm |
| 30 ± 1 | 0 ± 2 | 48 ± 1 | 4.7 ± 0.3 |
| 30 ± 1 | +20 ± 2 | 61 ± 1 | 4.9 ± 0.3 |
| 30 ± 1 | +90 ± 2* | 150 ± 1 | 8.0 ± 0.3 |
| 30 ± 1 | −20 ± 2 | 46 ± 1 | 4.3 ± 0.3 |
| 16 ± 1 | 0 ± 2 | 40 ± 1 | 4.3 ± 0.3 |

*The aerosol flare is directed outside the confines of the AG body, in contrast to other sprayer orientations.

It follows from the data presented that the productivity of an AG and the sizes of the aerosol generated when an inorganic salt solution is dispersed do not differ significantly from similar values when dispersing pure water. A change in the position of the sprayers alters the productivity of the AG and the sizes of the aerosol generated-removal of the sprayer from the wall and increasing the inclination angle of the ejector upwards from the horizontal results in an increase in device productivity with a one-time increase in particle size of the aerosol produced.

EXAMPLE 3

Dependence of AG Productivity and Mass Median Aerosol Drop Size on the Viscosity of Dispersed Liquids when Solutions of Organic Compounds are Dispersed The trials were conducted under the conditions of example 1 with the AG operating in mode A (table 3) and mode B (table 4). The productivity of the AG was measured—the amount of aerosol-forming liquid (M) and mass median size of aerosol particles ($d_{mmd}$) while atomizing the model liquid—for aqueous solutions of glycerine with a viscosity from 1 (water) to 300 (a 91% glycerine solution) centipoises at a temperature of 20±1° C.

TABLE 3

Dependence of AG productivity and mass median size of aerosol particles on viscosity of the dispersed liquid (mode A).

| Glycerine concentration, % | Solution viscosity, cP | Flow rate of liquid during atomization, ml per minute | $d_{mmd}$, μm |
|---|---|---|---|
| 0.0 | 1.0 | 12.0 | 4.4 |
| 4.6 | 1.1 | 11.5 | 3.7 |
| 10.0 | 1.3 | 10.5 | 3.1 |
| 23.0 | 1.6 | 8.5 | 2.9 |
| 46.0 | 3.9 | 8.0 | 2.6 |
| 84.0 | 100 | 3.0 | 2.1 |
| 91.0 | 300 | 2.0 | 1.9 |

TABLE 4

Dependence of AG productivity and mass median size of aerosol particles on viscosity of the dispersed liquid (mode B)

| Glycerine concentration, % | Solution viscosity, cP | Flow rate of liquid during atomization, ml per minute | $d_{mmd}$, μm |
|---|---|---|---|
| 0.0 | 1.0 | 48.0 ± 0.2 | 6.0 ± 0.5 |
| 10.0 | 1.3 | 41.2 ± 0.2 | 5.1 ± 0.5 |
| 25.0 | 2.1 | 34.0 ± 0.3 | 4.1 ± 0.5 |
| 40.0 | 3.8 | 32.1 ± 0.2 | 4.0 ± 0.5 |
| 60.0 | 11.0 | 24.0 ± 0.2 | 3.0 ± 0.5 |
| 80.0 | 62.0 | 12.4 ± 0.2 | 1.7 ± 0.5 |
| 91.0 | 300 | 8.4 ± 0.2 | 1.0 ± 0.5 |

It follows from the data presented that as the viscosity of the solution containing an organic compound rises, the productivity of the AG and the size of aerosol particles generated decrease. In all instances, when the AG operated in stable fashion, an even dispersion of the solutions over time was observed.

EXAMPLE 4

Use of AGs for Aerosol Formation in Solutions that Become Frothy in the Process of Dispersing The trials were conducted under the conditions of example 1 with the cover removed and in mode B. Solutions of ox serum albumen (OSA) were atomized as its content was altered from 2 to 20 g per 1, with a large amount of froth formed intensively within the AG body when compressed air was fed in, and with intensive mixing of the solution. Measurements were made of the productivity of the AG—the amount of liquid being atomized (M) and the mass median size of aerosol particles ($d_{mmd}$). The results obtained are presented in table 5.

TABLE 5

Dependence of AG productivity and mass median size of aerosol particles on the content of OSA in a liquid being dispersed.

| OSA content, grams/liter | M, ml per minute | $d_{mmd}$, μm |
|---|---|---|
| 0 | 60 ± 1 | 4.0 ± 0.3 |
| 2 ± 0.1 | 56 ± 3 | 4.1 ± 0.4 |
| 20.0 ± 0.1 | 57 ± 5 | 3.9 ± 0.4 |

It follows from the data presented that an AG effectively generates an aerosol in the presence of a foaming ingredient, i.e. under conditions that make the operation of other aerosol generators difficult. In the observed range of OSA concentrations, all of the solutions dispersed with virtually identical results.

EXAMPLE 5

Aerosol Formation of Mixed Solutions Including Organic and Inorganic Components The trials were conducted under the conditions of example 1, with the AG operating in mode B. A solution was atomized which contained 75% by weight of water, 20% by weight of glycerine and 5% by weight of sodium chloride. The results obtained are presented in table 6.

TABLE 6

Comparison of results of aerosol formation of water and of an aqueous solution containing 20% by weight of glycerine and 5% by weight of sodium chloride.

| OSA content, grams/liter | M, ml per minute | $d_{mmd}$, μm |
|---|---|---|
| water | 49 ± 1 | 4.7 ± 0.3 |
| Solution of glycerine and NaCl | 36 ± 1 | 4.1 ± 0.5 |

It follows from the data that the AG may be used successfully to atomize multi-component solutions. The differences in the results of aerosol formation are caused by differences in solution viscosities.

EXAMPLE 7

Aerosol Formation in Heterogeneous Systems

The trials were conducted under the conditions of example 1 with the generator operating in mode B. The following were subjected to aerosol formation:

1. a reverse water-oil emulsion containing mineral oil with a viscosity of 70 centipoises at 20° C.-60% by weight; emulsifier T-2—10% by weight; water 30% by weight. (hereinafter emulsion)
2. a calcium carbonate suspension obtained from mixing 70 ml of water, 5 ml of a 20% aqueous solution of calcium chloride and 80 ml of a 5% aqueous solution of sodium hydrocarbonate (hereinafter suspension)
3. a 3% aqueous solution of sodium chloride and water (base for comparison)

The results obtained are presented in table 7.

TABLE 7

Comparison of results of aerosol formation of an aqueous solution containing 3% by weight of sodium chloride and heterophase systems.

| Liquid | M, ml per minute | $d_{mmd}$, μm |
|---|---|---|
| water | 40 ± 1 | 4.3 ± 0.3 |
| NaCl solution | 48 ± 1 | 4.7 ± 0.3 |
| Emulsion | 27 ± 3 | 3.7 ± 0.3 |
| Suspension | 51 ± 2 | 5.9 ± 0.3 |

The results obtained are evidence of the possibility of using an AG to atomize suspensions and emulsions. As a result of intensive mixing of the dispersed liquid in the AG body, its uniformity is maintained in the process of aerosol formation.

What is claimed is:

1. An aerosol generating device for generating and mixing particles having a diameter of 5 μm or less into air; said device comprising:

a cylindrical container, having a bottom connected circumvolvingly to a wall which connects said bottom with a top edge to define a container chamber and an open top; and at least one ejector atomizer positioned within said container chamber, said ejector atomizer having-an internal wall which defines an internal mixing chamber and an outlet opening having a diameter, said internal mixing chamber configured to receive a liquid to be atomized from a liquid supply branch pipe through a liquid supply branch pipe opening, and to permit mixing of that liquid with pressurized air delivered to the mixing chamber from an air supply branch pipe through an air supply branch pipe opening positioned coaxially to the mixing chamber, each of said liquid supply branch opening, said outlet opening and said air supply branch opening having a diameter, said air supply branch pipe opening positioned to as to deliver air tangentially with respect to said internal wall; the ratio of the values of the cross-sections of the branch pipe openings of air and liquid and the outlet opening of the ejector nozzle is described by the equation $Do=(0.5\div0.7)D^2c/Dk$, wherein Do is the diameter of the liquid supply branch pipe opening, Dc is the diameter of the outlet opening, Dk is the diameter of the air supply opening;

the ejector atomizer is positioned within the container chamber in such a way so as to direct a jet of an aerosol discharge consisting of liquid particles suspended in air coming out of the outlet opening to be chordwisely oriented with respect to the walls of the cylindrical container, so that the projection of the central axis of the aerosol discharge on the walls of the container chamber does not cross the top edge;

whereby aerosols are created and dispersed in a tangential vortical motion which creates, partial dehydration and reduction of the aerosol particles size resulting in the release of fine particles into air.

2. The Aerosol generating device of claim 1 further comprising a cover adapted to connect to said top edge, said cover further defining a cover opening.

3. The Aerosol generating device of claim 2 further comprising a reflector plate positioned within said container chamber at a position higher than a top surface of a liquid positioned within said container.

4. The Aerosol generating device of claim 3 further comprising at least two ejector nozzles, each of said nozzles configured to be variably adjustable with respect to a horizontal plane.

* * * * *